US008827758B2

(12) United States Patent
Agemura

(10) Patent No.: US 8,827,758 B2
(45) Date of Patent: Sep. 9, 2014

(54) MARINE VESSEL PROPULSION DEVICE

(75) Inventor: Kazuyuki Agemura, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 182 days.

(21) Appl. No.: 13/544,179

(22) Filed: Jul. 9, 2012

(65) Prior Publication Data

US 2013/0109255 A1 May 2, 2013

(30) Foreign Application Priority Data

Oct. 26, 2011 (JP) ..... 2011-234779

(51) Int. Cl.
*B63H 21/22* (2006.01)
*B63H 21/21* (2006.01)

(52) U.S. Cl.
CPC ..... *B63H 21/21* (2013.01)
USPC ..... 440/1; 701/21; 440/83; 440/75

(58) Field of Classification Search
USPC ..... 440/83, 1
See application file for complete search history.

(56) References Cited

U.S. PATENT DOCUMENTS

| | | | | | |
|---|---|---|---|---|---|
| 4,747,796 | A | * | 5/1988 | Iwai et al. | 440/83 |
| 5,952,564 | A | * | 9/1999 | Naito et al. | 73/115.01 |
| 5,992,599 | A | * | 11/1999 | Hallenstvedt et al. | 192/109 F |
| 6,322,407 | B1 | * | 11/2001 | Onoue | 440/52 |
| 6,568,372 | B1 | * | 5/2003 | Kanno | 123/491 |
| 6,800,002 | B2 | * | 10/2004 | Katayama et al. | 440/1 |
| 7,140,932 | B2 | * | 11/2006 | Mizuguchi et al. | 440/75 |
| 7,238,070 | B2 | * | 7/2007 | Asakaze | 440/83 |
| 2013/0109255 | A1 | * | 5/2013 | Agemura | 440/1 |

FOREIGN PATENT DOCUMENTS

| | | | | |
|---|---|---|---|---|
| JP | 55-5453 | A | | 1/1980 |
| JP | 60-215495 | A | | 10/1985 |
| JP | 60215495 | A | * | 10/1985 |
| JP | 2006-183694 | A | | 7/2006 |
| JP | 2006183694 | A | * | 7/2006 |

* cited by examiner

*Primary Examiner* — Lars A Olson
*Assistant Examiner* — Jovon Hayes
(74) *Attorney, Agent, or Firm* — Keating & Bennett, LLP

(57) ABSTRACT

A marine vessel propulsion device includes an engine, a propeller shaft, a drive shaft that is rotated by power transmitted from the engine, a dog clutch that transmits rotation of the drive shaft to the propeller shaft, and an engine load generating unit. The engine load generating unit detects relative rotation speed between the drive shaft and the propeller shaft, and generates an engine load opposite in phase to the relative rotation speed detected therebetween.

12 Claims, 7 Drawing Sheets

MARINE VESSEL PROPULSION DEVICE

BACKGROUND OF THE INVENTION

1. Field of the Invention

The present invention relates to a marine vessel propulsion device in which the power of an engine is transmitted to a propeller shaft through a drive shaft and a dog clutch. Examples of such a marine vessel propulsion device include an outboard motor and astern drive.

2. Description of the Related Art

An outboard motor according to a conventional technique is disclosed by Japanese Unexamined Patent Application Publication No. 2006-183694. This outboard motor includes an engine, a drive shaft whose upper end is connected to a crankshaft of the engine, a forward/backward movement switching mechanism connected to a lower end of the drive shaft, a propeller shaft connected to the forward/backward movement switching mechanism, and a propeller attached to the propeller shaft. The forward/backward movement switching mechanism arranges a dog clutch that includes a pair of bevel gears that rotate in mutually opposite directions by means of power transmitted from the drive shaft and a dog gear that is splined to the propeller shaft. A driving force is transmitted to the propeller shaft by allowing the dog gear to engage with either of the pair of bevel gears. A damper structure that reduces the occurrence of an abnormal noise caused by a torque variation of the engine is disposed at a place between both ends of the drive shaft. Relative rotation between the bevel gear and the dog gear in the dog clutch is caused by the torque variation of the engine, and these are brought into contact with each other or are separated from each other. A gear rattle is repeatedly caused by shocks caused when coming into contact therewith, and a so-called rattling noise is caused. This gear rattle is deadened by the damper structure. The rotational fluctuation of the engine is liable to occur when the engine rotation speed is low (especially when idling). Moreover, an engine sound is low when the engine rotation speed is low, and therefore the gear rattle is conspicuously easily heard.

SUMMARY OF THE INVENTION

The inventors of preferred embodiments of the present invention described and claimed in the present application conducted an extensive study and research regarding a marine vessel propulsion device, such as the one described above, and in doing so, discovered and first recognized new unique challenges and previously unrecognized possibilities for improvements as described in greater detail below.

In Japanese Unexamined Patent Application Publication No. 2006-183694, a gear rattle is intended to be deadened by the damper structure disposed at a location between both ends of the drive shaft. However, this solution inevitably brings about an increase in the number of components, and, correspondingly, the assembly man-hours becomes greater, and the cost becomes higher.

In order to overcome the previously unrecognized and unsolved challenges described above, one preferred embodiment of the present invention provides a marine vessel propulsion device capable of reducing an abnormal noise resulting from the relative rotation speed between a drive shaft and a propeller shaft without depending on a mechanical component.

More specifically, one preferred embodiment of the present invention provides a marine vessel propulsion device including an engine, a propeller shaft, a drive shaft that is rotated by power transmitted from the engine, a dog clutch that transmits rotation of the drive shaft to the propeller shaft, and an engine load generating unit that detects relative rotation speed between the drive shaft and the propeller shaft and that generates an engine load opposite in phase to the relative rotation speed detected therebetween (i.e., an engine load having a phase that cancels the detected relative rotation speed).

According to this arrangement, the relative rotation speed between the drive shaft and the propeller shaft is detected, and the engine load generating unit generates an engine load that is opposite in phase to the relative rotation speed. As a result, the relative rotation speed between the drive shaft and the propeller shaft is canceled or offset by the engine load, and therefore gears in the dog clutch can avoid engaging each other violently. Accordingly, a gear rattle can be reduced. The occurrence of an abnormal noise resulting from the relative rotation speed between the drive shaft and the propeller shaft can be reduced in this way without depending on mechanical components, and therefore disadvantages, such as an increase in the number of components, an increase in the assembly man-hours, and an increase in cost, that occur in the conventional technique can be solved.

In one preferred embodiment of the present invention, the engine load generating unit includes a power generator that is driven by power transmitted from the engine and a control unit that controls a load of the power generator. According to this arrangement, a load applied to the engine can be controlled by controlling the power generation load of the power generator. Therefore, an exclusive component is not required to be provided to apply a load to the engine, and therefore the structure is simple, and the occurrence of an abnormal noise can be restrained without adding mechanical components.

In one preferred embodiment of the present invention, the marine vessel propulsion device further includes a flywheel joined to a crankshaft of the engine, and, in the marine vessel propulsion device, the engine load generating unit is arranged so as to detect a rotational fluctuation of the flywheel and so as to apply a load opposite in phase to the rotational fluctuation detected thereby to the flywheel. According to this arrangement, the rotational fluctuation of the engine is detected by using the flywheel that is a component used to stabilize the rotation of the engine. The rotational fluctuation of the engine causes relative rotation speed between the drive shaft and the propeller shaft. Therefore, the rotation of the engine can be stabilized by applying a load to the engine so as to cancel the rotational fluctuation of the flywheel detected thereby, and, as a result, the relative rotation speed between the drive shaft and the propeller shaft can be reduced.

In one preferred embodiment of the present invention, the engine load generating unit includes a power generator that generates electric power by rotation of the flywheel and a control unit that controls a load of the power generator. According to this arrangement, a load used to restrain the rotational fluctuation of the flywheel, i.e., to restrain the rotational fluctuation of the engine can be applied to the engine by controlling a load of the power generator using the rotation of the flywheel. Therefore, the relative rotation speed between the drive shaft and the propeller shaft resulting from the rotational fluctuation of the engine can be reduced without providing an exclusive mechanical component.

In one preferred embodiment of the present invention, under the condition that the relative rotation speed satisfies an engine load control condition, the engine load generating unit is arranged so as to generate an engine load that is opposite in phase to the relative rotation speed. In other words, in the present preferred embodiment, an engine load that cancels the relative rotation speed is not always generated, and is controlled under the condition that the engine load control condition is satisfied. Therefore, a useless control operation can be avoided, and a useless load can avoid being applied to the engine.

The engine load control condition may include a condition concerning a magnitude of the relative rotation speed. When the relative rotation speed is small, a remarkable abnormal noise does not occur, and therefore it is effective to control the engine load when the relative rotation speed is great to a certain degree.

More specifically, the condition concerning the magnitude of the relative rotation speed may include a condition concerning a variation width (an engine rotation speed deviation) of actual rotation speed of the engine with respect to targeted engine rotation speed proportionate to a thrust force command value to be generated by the marine vessel propulsion device. The propeller shaft rotates while receiving resistance from water transmitted from the propeller, and therefore great fluctuations do not occur in its rotation. On the other hand, the engine inevitably undergoes rotational fluctuations resulting from unevenness in torque caused by combustion, and, in response thereto, an unavoidable rotational fluctuation is caused in the drive shaft. In other words, the rotational fluctuation of the engine is a main cause of the relative rotation speed between the drive shaft and the propeller shaft. Therefore, if a load onto the engine is controlled when the variation width of the actual engine rotation speed with respect to the targeted engine rotation speed becomes great, the relative rotation speed between the drive shaft and the propeller shaft can be effectively reduced.

In one preferred embodiment of the present invention, when the engine load control prohibition condition is satisfied, the engine load generating unit does not generate an engine load that is opposite in phase to the relative rotation speed. According to this arrangement, the control of the engine load is not always performed, and the control thereof is not performed when the engine load control prohibition condition is satisfied. Therefore, the engine load can be controlled under an appropriate condition.

In detail, preferably, the engine load control prohibition condition includes an operational state condition concerning an operational state of the marine vessel propulsion device. For example, preferably, the operational state condition includes the condition that the rotation speed of the engine is greater than a threshold value (preferably, a threshold value greater than idle rotation). When the engine rotation speed is high, the engine generates great output, and the propeller receives great resistance from water, and therefore the engagement state of the gears in the dog clutch is stable. Additionally, the engine sound is loud, and therefore an abnormal noise caused from the dog clutch is muffled by the engine sound. Therefore, a useless control operation can be omitted by prohibiting the control of the engine load when the engine rotation speed is high, and a needless load can avoid being applied to the engine.

Preferably, the operational state condition includes the condition that the actual rotation speed of the engine has not yet reached the targeted engine rotation speed proportionate to the thrust force command value to be generated by the marine vessel propulsion device after the thrust force command value changes. More specifically, preferably, the operational state condition includes the condition that the time required for the actual engine rotation speed of the engine to reach the targeted engine rotation speed proportionate to the thrust force command value to be generated by the marine vessel propulsion device has not yet elapsed after the thrust force command value changes. According to this arrangement, the control of a load onto the engine is not performed until the actual engine rotation speed reaches the targeted engine rotation speed proportionate to a thrust force command value, and therefore the engine rotation speed can be allowed to promptly reach the targeted engine rotation speed, and a thrust force according to a command can be generated. Additionally, the engine is in an accelerated state or a decelerated state until the actual engine rotation speed reaches the targeted engine rotation speed after the thrust force command value changes, and the engagement of gears in the dog clutch is stable, and the possibility that a gear rattle will occur is low. From this viewpoint, the necessity of controlling the load of the engine is low during a period before the actual engine rotation speed reaches the targeted engine rotation speed.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
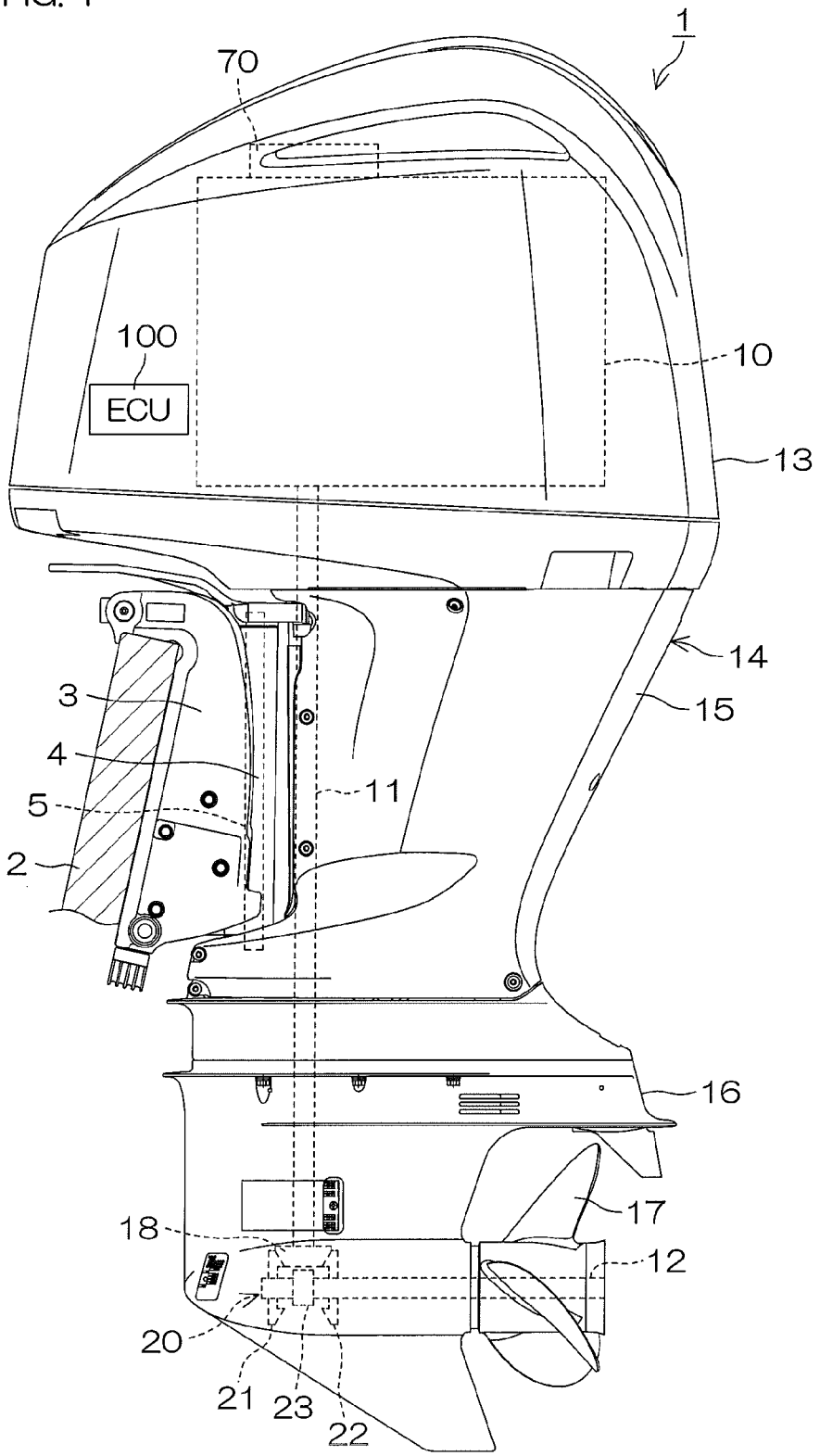
FIG. 1 is a side view of an outboard motor used as a marine vessel propulsion device according to a preferred embodiment of the present invention.

FIG. 1 is a side view of an outboard motor 1 used as a marine vessel propulsion device according to a preferred embodiment of the present invention. The outboard motor 1 is attached to a transom 2 of a hull, and applies a thrust force to the hull. The outboard motor 1 is attached to the transom 2 through a clamping bracket 3, a swivel bracket 4, and a steering shaft 5. The clamping bracket 3 is fixed to the transom 2, and the swivel bracket 4 is connected to the clamping bracket 3 so as to be rotatable around a horizontal axis. The steering shaft 5 is connected to the swivel bracket 4 so as to be rotatable around its axis. The steering shaft 5 is integrally united with the outboard motor 1. Therefore, the outboard motor 1 is laterally rotatable around the axis of the steering shaft 5, and is rotatable in an up-down direction together with the swivel bracket 4.

The outboard motor 1 includes an engine 10 that generates power, a drive shaft 11 rotationally driven in a constant direction by the engine 10, and a propeller shaft 12 to which the rotation of the drive shaft 11 is transmitted. The outboard motor 1 additionally includes an engine cover 13 that contains the engine 10 and a casing 14 disposed below the engine cover 13. The casing 14 includes an upper case 15 and a lower case 16 disposed below the upper case 15. The drive shaft 11 extends in a vertical direction in the upper and lower cases 15 and 16. An upper end of the drive shaft 11 is connected to the crankshaft of the engine 10, and a lower end of the drive shaft 11 is connected to the propeller shaft 12 through the dog clutch 20. The propeller shaft 12 extends in a horizontal direction in the lower case 16. A rear end of the propeller shaft 12 protrudes rearwardly from the lower case 16, and a propeller 17 is connected to the rear end. The propeller 17 is rotationally driven by power transmitted from the engine 10. The dog clutch 20 is arranged so as to be switchable among a forward engaged state, a backward engaged state, and a disengaged state. The "forward engaged state" is a state in which the dog clutch 20 transmits power from the drive shaft 11 to the propeller shaft 12 so as to rotate the propeller shaft 12 in a forward rotation direction. The "forward rotation direction" is a rotation direction in which the propeller 17 applies a thrust force in a forward direction to the hull. The "backward engaged state" is a state in which the dog clutch 20 transmits power from the drive shaft 11 to the propeller shaft 12 so as to rotate the propeller shaft 12 in a backward rotation direction. The "backward rotation direction" is a rotation direction in which the propeller 17 applies a thrust force in a backward direction to the hull. The "disengaged state" is a state in which the dog clutch 20 shuts off driving-force transmission between the drive shaft 11 and the propeller shaft 12. The propeller 17 rotates in the forward rotation direction or in the backward rotation direction together with the propeller shaft 12.

Figure 2:
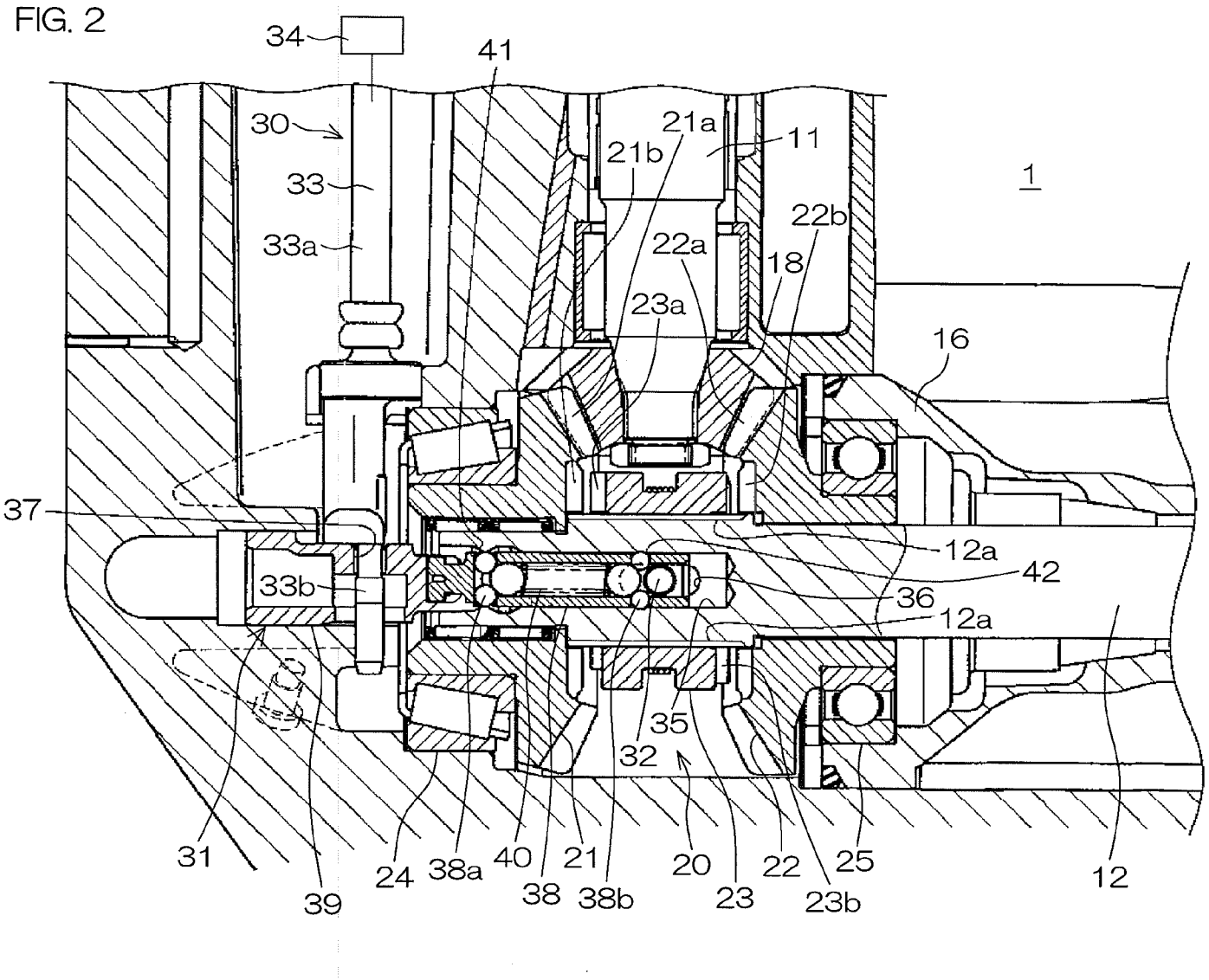
FIG. 2 is a sectional view of a lower portion of the outboard motor.

FIG. 2 is a sectional view of a lower portion of the outboard motor 1. The dog clutch 20 includes a forward gear 21 and a backward gear 22 that are rotatable around the propeller shaft 12 and a dog gear 23 that is splined to the propeller shaft 12 between the forward gear 21 and the backward gear 22. A driving gear 18 including bevel gears is fixed to a lower end of the drive shaft 11. The forward gear 21 preferably is a bevel gear arranged to engage the driving gear 18 from in front of the outboard motor 1. The backward gear 22 preferably is a bevel gear arranged to engage the driving gear 18 from behind the outboard motor 1. Therefore, when the driving gear 18 rotates, the forward gear 21 and the backward gear 22 rotate in mutually opposite directions around the propeller shaft 12. In other words, the forward gear 21 rotates in the forward rotation direction, whereas the backward gear 22 rotates in the backward rotation direction. The dog gear 23 moves in the axial direction of the propeller shaft 12, and, as a result, can be disposed at any shift position among a forward position at which it engages the forward gear 21, a backward position at which it engages the backward gear 22, and a neutral position at which it engages neither the gear 21 nor the gear 22. The dog clutch 20 reaches the forward engaged state when the dog gear 23 is at the forward position, and reaches the backward engaged state when the dog gear 23 is at the backward position, and reaches the disengaged state when the dog gear 23 is at the neutral position.

On the outer peripheral side of one side-surface of each of the forward and backward gears 21 and 22, input gears 21*a* and 22*a* into which a driving force is input from the driving gear 18 are provided for the forward and backward gears 21 and 22, respectively, whereas on the inner peripheral side thereof, engagement portions 21*b* and 22*b* that are to engage the dog gear 23 are provided therefor, respectively. The forward gear 21 and the backward gear 22 are disposed around the propeller shaft 12 without being joined to the propeller shaft 12, and are rotatably held by bearings 24 and 25 fixed to the lower case 16, respectively. The forward gear 21 and the backward gear 22 are in a state of always engaging the driving gear 18 of the drive shaft 11, and are always driven in mutually opposite directions by the rotation of the drive shaft 11.

The dog gear 23 preferably has a substantially cylindrical shape, and, on its inner peripheral surface, includes spline teeth that are splined to spline teeth 12*a* located on the outer peripheral surface of the propeller shaft 12. The dog gear 23 includes engagement portions 23*a* and 23*b* that can engage the forward gear 21 and the backward gear 22 on both end surfaces, respectively. When the dog gear 23 is at the forward position, the engagement portion 23*a* engages the engagement portion 21*b* of the forward gear 21, and, when the dog gear 23 is at the backward position, the engagement portion 23*b* engages the engagement portion 22*b* of the backward gear 22. When the dog gear 23 is at the neutral position, the engagement portions 23*a* and 23*b* engage neither the forward gear 21 nor the backward gear 22.

The outboard motor 1 includes a shift mechanism 30 that switches the shift position of the dog gear 23. The shift mechanism 30 includes a slider 31 inserted in a front end of the propeller shaft 12, a connection pin 32 that connects the slider 31 and the dog gear 23 together, a cam 33 that moves the slider 31 in a front-rear direction, and a shift actuator 34 that rotates the cam 33. The slider 31 is inserted in an insertion hole 35 defined in the propeller shaft 12. The insertion hole 35 extends rearwardly from the front end of the propeller shaft 12 along a central axis of the propeller shaft 12. The slider 31 is movable in the front-rear direction along the insertion hole 35. A front end of the slider 31 protrudes forwardly from the front end of the propeller shaft 12, and a rear end of the slider 31 is disposed in a through-hole 36 defined in the propeller shaft 12. The through-hole 36 is a long hole that perpendicularly intersects the insertion hole 35, that penetrates the propeller shaft 12 in a direction perpendicular to its axial direction, and that extends in this axial direction.

The connection pin 32 is connected to the slider 31 inside the propeller shaft 12, i.e., at the intersection of the insertion hole 35 and the through-hole 36. The connection pin 32 perpendicularly intersects the propeller shaft 12, and both ends of the connection pin 32 protrude from the outer peripheral surface of the propeller shaft 12. Both ends of the connection pin 32 are connected to the dog gear 23 between the engagement portions 23*a* and 23*b*. In other words, the dog gear 23 and the slider 31 are connected together so as to move together with each other in the axial direction of the propeller shaft 12 via the connection pin 32. The through-hole 36 is a long hole that is elongated in the axial direction of the propeller shaft 12. Therefore, the dog gear 23, the slider 31, and the connection pin 32 are movable in the front-rear direction within the range of the length of the through-hole 36.

The cam 33 includes a rod portion 33*a* and a pin portion 33*b* both of which extend in the vertical direction. The pin portion 33*b* protrudes downwardly from the rod portion 33*a*. The pin portion 33*b* is eccentric with respect to the central axis of the rod portion 33*a*. The pin portion 33*b* is inserted in a groove 37 formed at the front end of the slider 31. The shift actuator 34 rotates the cam 33 around the central axis of the rod portion 33*a*. The pin portion 33*b* moves in the front-rear direction (in FIG. 2, in the right-left direction) while rotating around the central axis of the rod portion 33*a* by the rotation of the cam 33. Therefore, the slider 31 moves in the front-rear direction together with the connection pin 32 and the dog gear 23 in response to the rotation of the cam 33. Accordingly, the rotation of the cam 33 allows the dog gear 23 to be placed at any shift position among the forward position, the backward position, and the neutral position.

The slider 31 includes a shift plunger 38 that is connected to the connection pin 32 and that is movable in the axial direction and a shift follower 39 joined to a front end of the shift plunger 38. The shift plunger 38 and the shift follower 39 are joined to each other so as to be relatively rotatable around the rotational axis of the propeller shaft 12. The pin portion 33*b* of the cam 33 engages the shift follower 39. Positioning balls 38*a* and 38*b* are disposed in a state of being urged in a diameter direction by a spring member 40 at two portions of the shift plunger 38, respectively. The positioning ball 38*a* engages the front side of a to-be-engaged convex portion 41 of the propeller shaft 12 at a position at which the dog gear 23 engages the forward gear 21. Furthermore, the positioning ball 38*a* engages the rear side of the to-be-engaged convex portion 41 at a position at which the dog gear 23 engages the backward gear 22. The positioning ball 38*b* engages a to-be-engaged concave portion 42 of the propeller shaft 12 at an intermediate position at which the dog gear 23 engages neither the forward gear 21 nor the backward gear 22.

When the engagement portion 23*a* of the dog gear 23 and the engagement portion 21*b* of the forward gear 21 engage each other, a backlash occurs therebetween. Likewise, when the engagement portion 23*b* of the dog gear 23 and the engagement portion 22*b* of the backward gear 22 engage each other, a backlash occurs therebetween. Therefore, if there is a difference between the rotation speed of the drive shaft 11 and the rotation speed of the propeller shaft 12 and if the relative rotation speed therebetween is not zero, the relative rotation between the drive shaft 11 and the propeller shaft 12 is allowed by the amount of the backlash mentioned above. In other words, from a state in which the engagement portions 23*a* and 23*b* of the dog gear 23 are in contact with the engagement portion 21*b* of the forward gear 21 or with the engagement portion 22*b* of the backward gear 22, these portions are separated from each other, and the relative rotation is then made by the amount of the backlash, and these portions come into contact with each other again. If the relative rotation speed is high, an impact noise will occur when the portions come into contact therewith again. This is a gear rattle (i.e., gear rattling noise). The rotational fluctuation of the engine 10 is great in a low-speed rotation range from the idle rotation speed to about 1500 rpm, and therefore the rotation of the drive shaft 11 becomes unstable and, as a result, a gear rattle is liable to occur.

Figure 3:
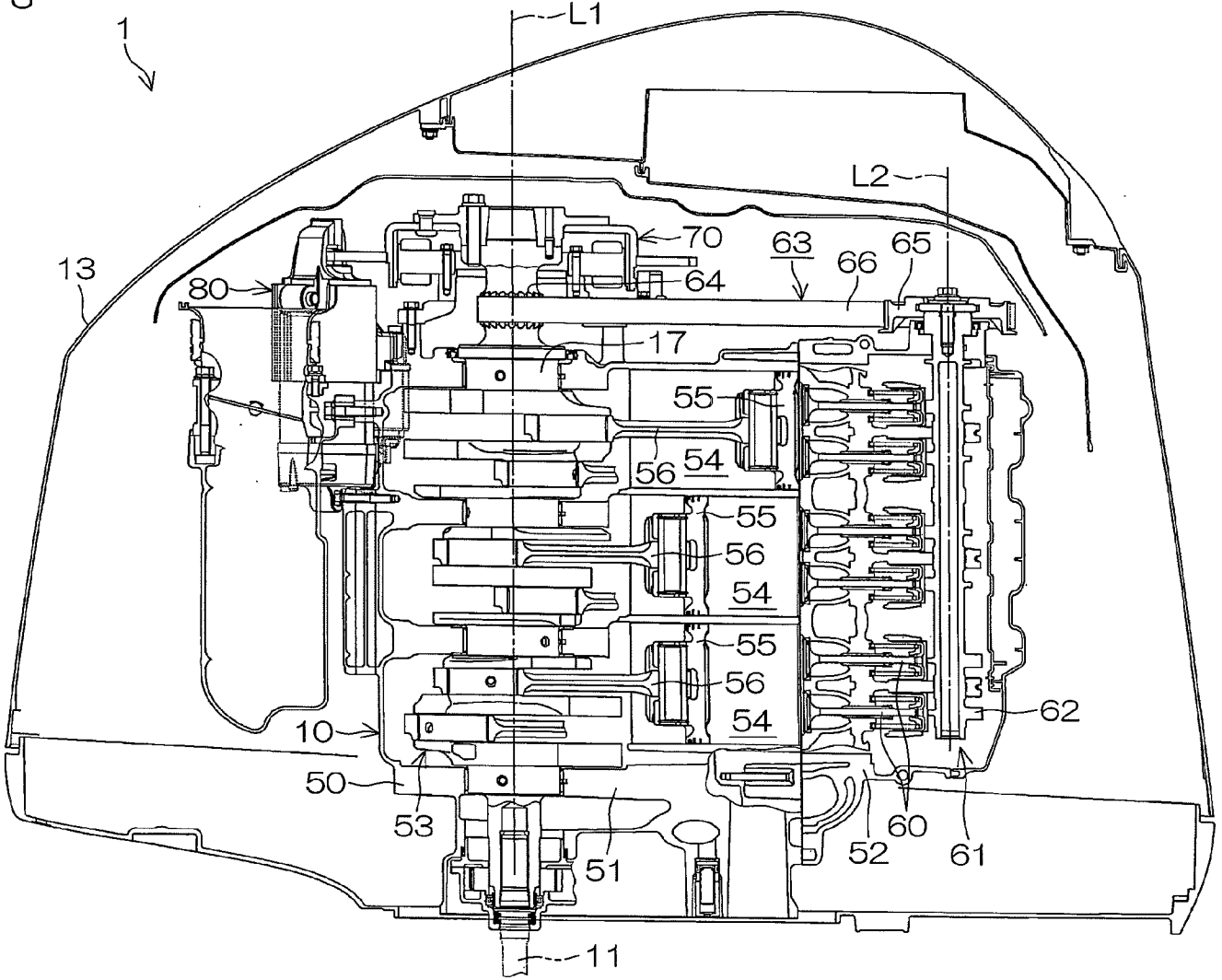
FIG. 3 is a sectional view for describing an arrangement inside an engine cover.

FIG. 3 is a sectional view for describing an arrangement inside the engine cover 13. However, in FIG. 3, hatching that represents a cross section is omitted.

The engine 10 includes a crankcase 50, a cylinder body 51, and a cylinder head 52. The engine 10 additionally includes a crankshaft 53 rotatable around a crankshaft axis L1 that extends in the up-down direction. The cylinder body 51 and the crankcase 50 hold the crankshaft 53 rotatably around the crankshaft axis L1. The drive shaft 11 is connected to a lower end of the crankshaft 53. The cylinder body 51 and the cylinder head 52 define a plurality of cylinders 54. The engine 10 may be a straight-type engine in which a plurality of cylinders are arranged linearly, or may be a V-type engine in which a plurality of cylinders are arranged along a V-shaped line, or may be another type engine. Each cylinder 54 extends in the horizontal direction. The engine 10 additionally includes a plurality of pistons 55 disposed in the cylinder 54 and a plurality of connecting rods 56 that connect the pistons 55 and the crankshaft 53 together.

The engine 10 additionally includes an intake valve 60 that opens and closes an intake port, an exhaust valve that opens and closes an exhaust port, and a valve driving mechanism 61 that drives the intake valve 60 and the exhaust valve. The valve driving mechanism 61 includes a camshaft 62 rotatable around a camshaft axis L2 parallel to the crankshaft axis L1. The intake valve 60, the exhaust valve, and the camshaft 62 are held by the cylinder head 52. The rotation of the crankshaft 53 is transmitted to the camshaft 62. As a result, the camshaft 62 is rotationally driven around the camshaft axis L2. The intake valve 60 and the exhaust valve are driven by the rotation of the camshaft 62.

The engine 10 additionally includes a winding transmission device 63 that transmits the rotation of the crankshaft 53 to the camshaft 62. The winding transmission device 63 includes a driving wheel 64, a driven wheel 65, and an endless transmission member 66 that is winding around the driving wheel 64 and around the driven wheel 65. The driving wheel 64 and the driven wheel 65 may be pulleys, or may be gears such as sprockets, for example. The transmission member 66 may be a belt, or may be a chain, for example. The driving wheel 64 is disposed on the crankshaft axis L1, and rotates around the crankshaft axis L1 together with the crankshaft 53. The driven wheel 65 is disposed on the camshaft axis L2, and rotates around the camshaft axis L2 together with the camshaft 62. The rotation of the driving wheel 64 is transmitted to the driven wheel 65 by the transmission member 66. As a result, the rotation of the crankshaft 53 is transmitted to the camshaft 62.

A flywheel magneto 70 serving as a power generator is joined to an upper end of the crankshaft 53. A starter 80 is disposed beside the flywheel magneto 70.

Figure 4:
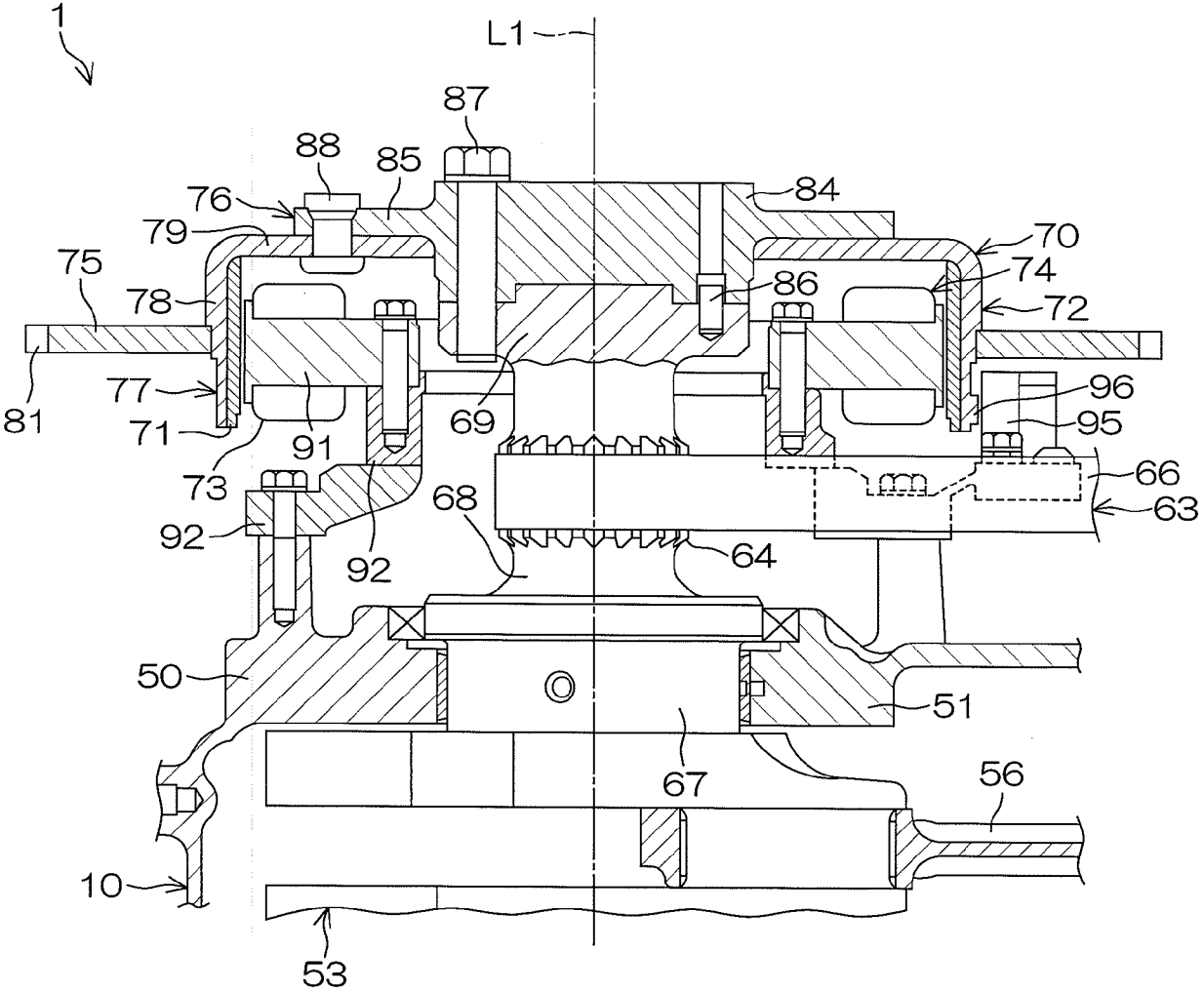
FIG. 4 is an enlarged sectional view of a portion of FIG. 3, and shows an arrangement near a flywheel magneto.

FIG. 4 is an enlarged sectional view of a portion of FIG. 3, and shows an arrangement near the flywheel magneto 70. The crankshaft 53 includes the driving wheel 64 at a shaft portion 68 above a journal 67, and includes a disk portion 69, which is used to attach a flywheel, at an upper end above the driving wheel 64. A portion of the crankshaft 53 above the journal 67 is disposed outside the crankcase 50 and the cylinder body 51.

The flywheel magneto 70 includes of a cylindrical rotor 72 that includes a magnet 71, a cylindrical stator 74 that includes a coil 73, a ring gear 75 that is connected to the rotor 72, and a connection member 76 that connects the rotor 72 and the crankshaft 53 together. The rotor 72, the ring gear 75, and the connection member 76 function also as a flywheel that saves a rotational force and that stabilizes the rotation of the engine 10.

The rotor 72 includes a magnet 71 and a cup-shaped holder 77. The holder 77 includes a cylindrical portion 78 that is coaxial with the crankshaft 53 and an annular portion 79 that extends inwardly from an upper end of the cylindrical portion 78. The cylindrical portion 78 has an inner diameter greater than the disk portion 69, and coaxially surrounds the disk portion 69. The magnet 71 is disposed between the cylindrical portion 78 and the disk portion 69. The magnet 71 is held by the inner peripheral surface of the cylindrical portion 78. The ring gear 75 is fit onto the outer periphery of the cylindrical portion 78. A gear 81 that engages a driving gear of the starter 80 (see FIG. 3) is disposed on the outer peripheral portion of the ring gear 75.

The connection member 76 includes a cylindrical connection portion 84 and an annular flange 85 that extends outwardly from the outer peripheral portion of the connection portion 84. The connection portion 84 is inserted in the annular portion 79. The connection portion 84 protrudes downwardly from the annular portion 79. The connection portion 84 and the disk portion 69 disposed at the upper end of the crankshaft 53 are vertically placed on each other inside the holder 77. The connection portion 84 and the disk portion 69 are positioned by a knock pin 86. The connection portion 84 is connected to the disk portion 69 preferably via a plurality of bolts 87. On the other hand, the flange 85 is disposed above the annular portion 79 of the holder 77. The flange 85 is connected to the annular portion 79 preferably via a plurality of rivets 88. Therefore, the rotor 72 is connected to the crankshaft 53 through the connection member 76. The rotor 72 is disposed on the crankshaft axis L1, and rotates around the crankshaft axis L1 together with the crankshaft 53.

The stator 74 includes the coil 73 and a cylindrical stator core 91 around which the coil 73 is wound. The stator 74 coaxially surrounds the disk portion 69 disposed at the upper end of the crankshaft 53. The stator 74 is disposed inside the magnet 71. The stator 74 faces the magnet 71 in the radial direction of the stator 74 with a gap therebetween. The stator 74 is connected to the crankcase 50 through the brackets 92 and 93. The stator 74 does not rotate with respect to the crankcase 50. Therefore, when the crankshaft 53 rotates around the crankshaft axis L1, the rotor 72 and the stator 74 rotate relatively. As a result, the rotation of the crankshaft 53 is converted into electric energy, and the flywheel magneto 70 generates electricity.

A crank angle sensor 95 is held by one bracket 93 holding the stator 74. The crank angle sensor 95 is disposed to face the rotor 72 of the flywheel magneto 70. More specifically, the holder 77 of the rotor 72 is made of a magnetic substance, and the cylindrical portion 78 has a plurality of detecting teeth 96 provided at a plurality of positions, respectively, that are evenly spaced in a circumferential direction in such a way as to protrude outwardly in the radial direction. However, one of the positions is a no-tooth position at which no detecting tooth 96 is provided. The rotation of the rotor 72 enables the plurality of detection teeth 96 to face the crank angle sensor 95 one after another. The magnetoresistance between the crank angle sensor 95 and the cylindrical portion 78 is small when the detecting teeth 96 face the crank angle sensor 95, whereas the magnetoresistance therebetween is great when the detecting teeth 96 do not face the crank angle sensor 95. A pulse signal corresponding to a change in the magnetoresistance is output from the crank angle sensor 95. The time interval of the pulse signal is inversely proportional to the rotation speed of the rotor 72 (i.e., to the engine rotation speed), and therefore the engine rotation speed can be calculated by measuring the time interval. Additionally, the pulse interval becomes long at the no-tooth position, and therefore the crank angle can be calculated by counting the number of pulses based on the no-tooth position. The ignition or fuel injection of the engine can be controlled by using a crank angle calculated in this way.

Figure 5:
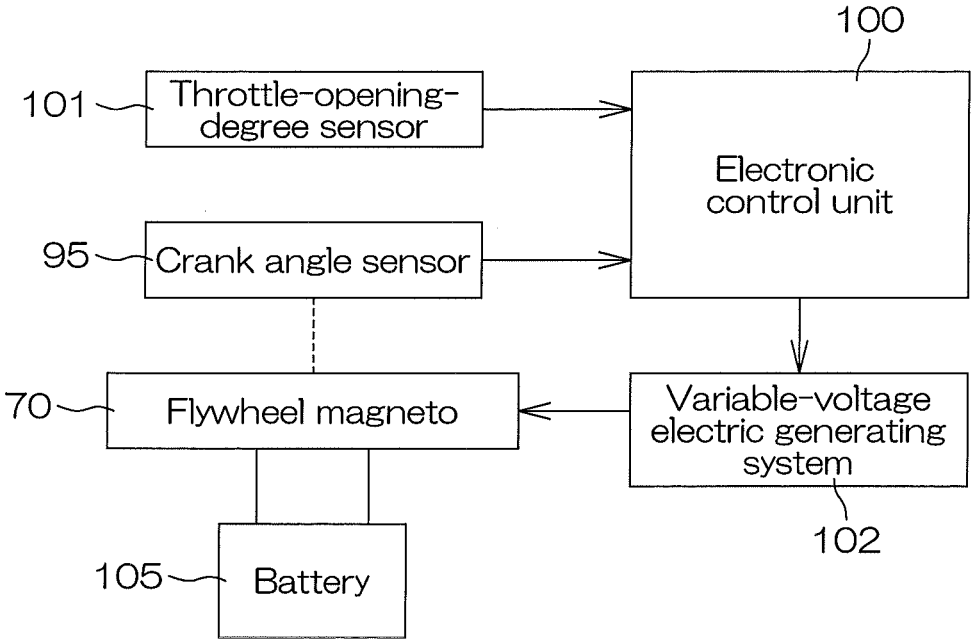
FIG. 5 is a block diagram for describing an electric arrangement of a main portion of the outboard motor.

FIG. 5 is a block diagram for describing an electric arrangement of a principal portion of the outboard motor 1. The outboard motor 1 has an electronic control unit (ECU) 100 that controls the engine 10. The crank angle sensor 95, a throttle-opening-degree sensor 101, and a variable-voltage electric generating system 102 are connected to the electronic control unit 100. As described above, the crank angle sensor 95 is arranged to generate a pulse signal having intervals corresponding to the engine rotation speed and to input this signal to the electronic control unit 100. The throttle-opening-degree sensor 101 is arranged to detect the throttle opening degree of the engine 10 and to input its output signal to the electronic control unit 100. The variable-voltage electric generating system 102 is arranged to variably control the power generation voltage of the flywheel magneto 70. A battery 105 is charged by the controlled voltage. The battery 105 is mounted in, for example, the hull, and supplies electric power to electric components of the outboard motor 1. The electronic control unit 100 variably controls the power generation voltage of the flywheel magneto 70 by controlling the variable-voltage electric generating system 102. The power generation load of the flywheel magneto 70 is varied by changing this power generation voltage. In other words, the power generation load of the flywheel magneto 70 becomes greater in proportion to a rise in the power generation voltage.

Thus, the electronic control unit 100 and the variable-voltage electric generating system 102 define a control unit that controls the load of the flywheel magneto 70 serving as a power generator. This control unit and the flywheel magneto 70 define an engine load generating unit that detects a variation in the engine rotation speed and that generates an engine load that has an opposite phase with respect to the detected variation.

Figure 6:
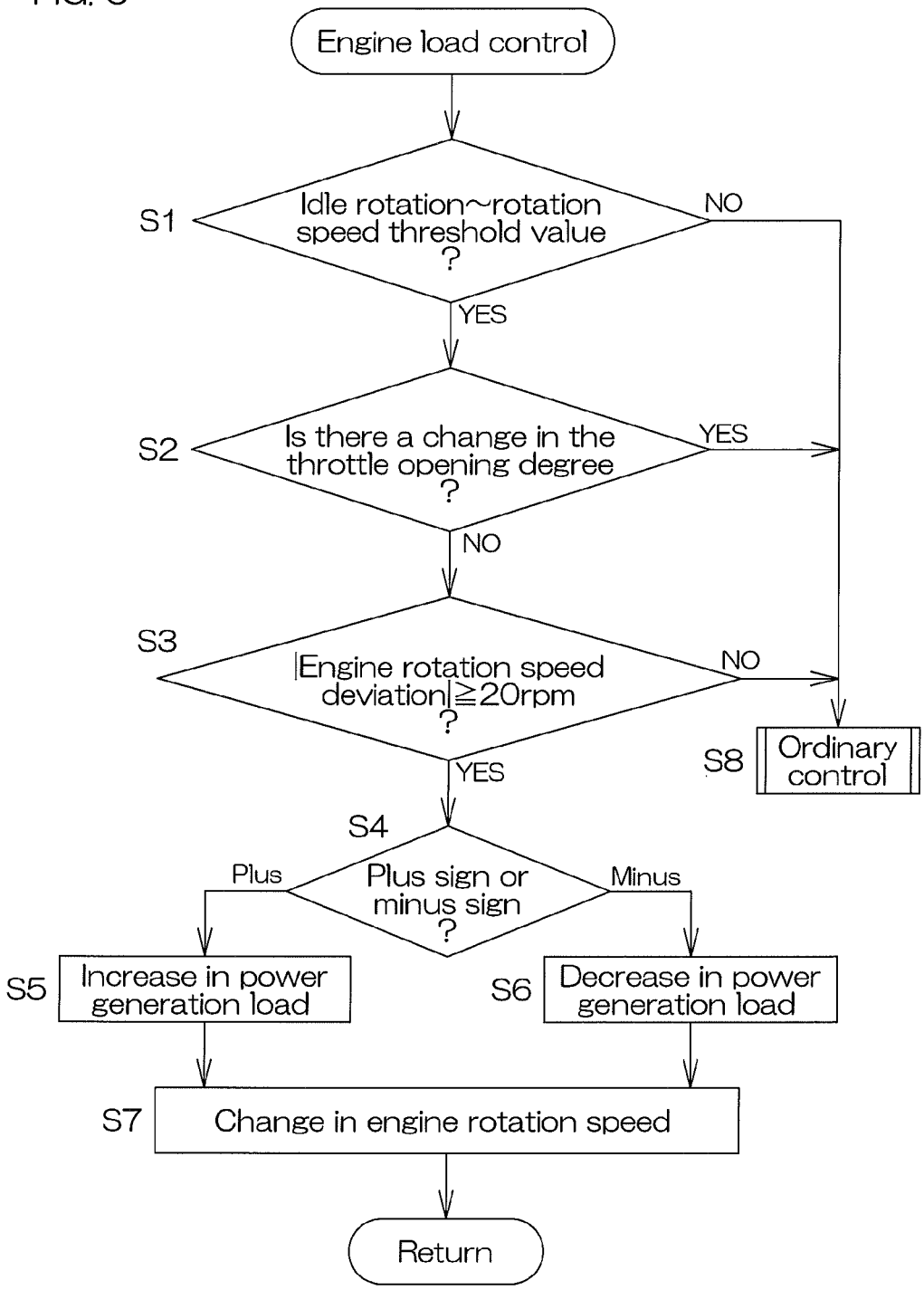
FIG. 6 is a flowchart for describing a control operation that is repeatedly performed by an electronic control unit for each predetermined control period.

FIG. 6 is a flowchart for describing a control operation that is repeatedly performed by the electronic control unit 100 for each predetermined control period. Based on an output signal of the crank angle sensor 95, the electronic control unit 100 calculates the engine rotation speed, and determines whether the engine rotation speed shows a value falling within the range from the idle rotation speed to a predetermined engine-rotation-speed threshold value (e.g., 1500 rpm) (step S1). This condition is one example of an engine load control prohibition condition, and is one example of an operational state condition concerning the operational state of the outboard motor 1.

If an affirmative determination is made at step S1, i.e., if the engine load control prohibition condition is not satisfied, the electronic control unit 100 further determines whether there is a change in the throttle opening degree during a past predetermined time (e.g., within one second) with reference to the output signal of the throttle-opening-degree sensor 101 (step S2). This condition is another example of an engine load control prohibition condition, and is another example of an operational state condition concerning the operational state of the outboard motor 1. In other words, at step S2, a determination is made as to whether the time (e.g., one second) required for the actual engine rotation speed to reach the targeted engine rotation speed has not yet elapsed after the targeted engine rotation speed is changed proportionately to a change in the throttle opening degree.

If there is no change in the throttle opening degree, the determination is negative at step S2, and the engine load control prohibition condition is dissatisfied. In this case, the electronic control unit 100 makes a determination concerning a difference (an engine rotation speed deviation) between the actual engine rotation speed calculated based on the output signal of the crank angle sensor 95 and the targeted engine rotation speed proportionate to the throttle opening degree (step S3). The actual engine rotation speed may be a mean value of engine-rotation-speed calculation results that are obtained by being calculated a predetermined number of times (e.g., four times) based on the output pulse intervals of the crank angle sensor 95. The electronic control unit 100 may be arranged to calculate the targeted engine rotation speed by referring to a table that stores targeted engine rotation speeds proportionate to throttle opening degrees.

If the absolute value of an engine rotation speed deviation is greater than a predetermined threshold value (e.g., 20 rpm) (Step S3: YES; one example of the engine load control condition), the electronic control unit 100 determines whether the engine rotation speed deviation is positive or negative (step S4). If the actual engine rotation speed is greater than the targeted engine rotation speed, the engine rotation speed deviation is positive, and if the actual engine rotation speed is smaller than the targeted engine rotation speed, the engine rotation speed deviation is negative.

Therefore, when the engine rotation speed deviation is positive, the electronic control unit 100 controls the variable-voltage electric generating system 102 so as to increase the power generation voltage of the flywheel magneto 70 (e.g., increase the voltage by a constant voltage width) and hence increase the power generation load (step S5). Accordingly, a load torque that the flywheel magneto 70 applies to the engine 10 becomes great, and therefore the engine rotation speed is restrained (step S7). As a result, the actual engine rotation speed is brought close to the targeted engine rotation speed. On the other hand, when the engine rotation speed deviation is negative, the electronic control unit 100 controls the variable-voltage electric generating system 102 so as to lower the power generation voltage of the flywheel magneto 70 (e.g., lower it by a constant voltage width) and hence lower the power generation load (step S6). Accordingly, a load torque that the flywheel magneto 70 applies to the engine 10 becomes small, and therefore the engine rotation speed is increased (step S7). As a result, the actual engine rotation speed is brought close to the targeted engine rotation speed. Thus, the electronic control unit 100 is arranged to apply a load having an opposite phase to a variation in the engine rotation speed (i.e., rotational fluctuation of the flywheel).

If the engine rotation speed shows a value outside the range from the idle rotation speed to the engine rotation speed threshold value (step S1: NO), steps S2 to S7 are skipped, and an ordinary control operation (step S8) is performed. If there is a variation in the throttle opening degree (step S2: YES), steps S3 to S7 are skipped, and an ordinary control operation (step S8) is performed so that an engine rotation speed change proportionate to the throttle opening degree occurs promptly. Likewise, if the absolute value of an engine rotation speed deviation is less than a predetermined threshold value (e.g., about 20 rpm), steps S4 to S7 are skipped, and an ordinary control operation (step S8) is performed.

As described above, in the present preferred embodiment, if the absolute value of an engine rotation speed deviation is greater than a threshold value (e.g., about 20 rpm) when there is no change in the throttle opening degree in a low-speed rotation range from the idle rotation speed to the engine rotation speed threshold value, it is determined that the rotational fluctuation of the engine 10 has occurred. Thereafter, the power generation load of the flywheel magneto 70 is controlled to cancel the rotational fluctuation of the engine 10. As a result, the rotational fluctuation of the engine 10 is restrained.

Figure 7A:
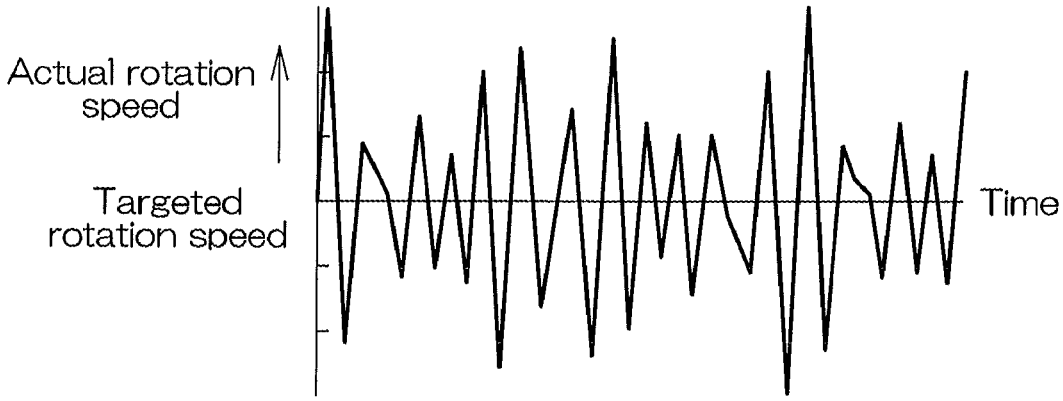
FIG. 7A is a waveform chart showing an example of a temporal change in actual engine rotation speed, and shows a variation with respect to targeted engine rotation speed.
Figure 7B:
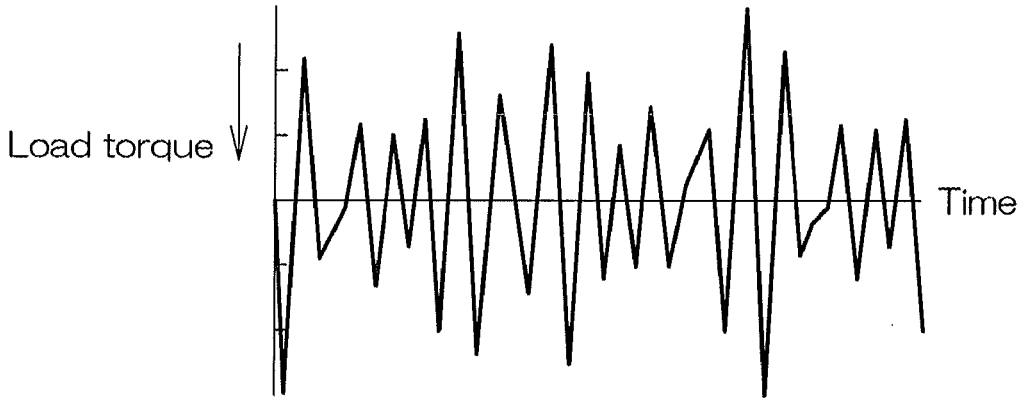
FIG. 7B is a waveform chart showing an example of the restraining control of an engine rotation speed variation that is performed by the electronic control unit when the engine rotation speed variation is detected as in FIG. 7A, and shows a temporal change in load torque generated by the flywheel magneto.

FIG. 7A is a waveform chart showing an example of a temporal change in the actual engine rotation speed, and shows a variation with respect to the targeted engine rotation speed. FIG. 7B is a waveform chart showing an example of engine load control (see FIG. 6) that is performed by the electronic control unit 100 when an engine rotation speed variation is detected as in FIG. 7A, and shows a temporal change in load torque generated by the flywheel magneto 70. A load torque applied by the flywheel magneto 70 to the engine 10 is opposite in phase to an engine rotation speed variation. The superimposition of these on each other makes it possible to restrict the engine rotation speed variation (e.g., within about 20 rpm).

As described above, according to the present preferred embodiment, a variation in the engine rotation speed with respect to the targeted engine rotation speed proportionate to a throttle opening degree is detected, and an engine load that is opposite in phase to this variation is generated from the flywheel magneto 70. As a result, the rotational fluctuation of the engine 10 is reduced, and therefore the relative rotation speed between the drive shaft 11 and the propeller shaft 12 resulting from the rotational fluctuation of the engine 10 can be reduced. Therefore, in the dog clutch 20, the forward gear 21 or the backward gear 22 and the dog gear 23 can avoid being separated from each other and being brought into contact with each other repeatedly. Therefore, the forward gear 21 or the backward gear 22 and the dog gear 23 can avoid engaging each other violently and causing a gear rattle (rattling noise). Thus, the occurrence of an abnormal noise resulting from the relative rotation speed between the drive shaft 11 and the propeller shaft 12 can be reduced without depending on mechanical components. Therefore, the outboard motor 1 capable of restraining a gear rattle can be provided while avoiding an increase in the number of components, an increase in the assembly man-hours, and an increase in cost.

The propeller shaft 12 rotates while receiving resistance from water, and therefore great fluctuations do not occur in its rotation. On the other hand, the drive shaft 11 is connected to the crankshaft 53, and therefore is influenced by a torque variation resulting from unevenness in combustion of the engine 10, and unavoidably causes rotational fluctuations. In other words, the rotational fluctuation of the engine 10 is a main cause of the relative rotation speed between the drive shaft 11 and the propeller shaft 12. Therefore, in the present preferred embodiment, the relative rotation speed between the drive shaft 11 and the propeller shaft 12 is indirectly detected by detecting a variation in the engine rotation speed, and a load onto the engine 10 is controlled when the variation width (engine rotation speed deviation) of the actual engine rotation speed with respect to the targeted engine rotation speed becomes great. This makes it possible to effectively reduce the relative rotation speed between the drive shaft 11 and the propeller shaft 12 and to reduce a gear rattle.

Additionally, in the present preferred embodiment, the power generation load of the flywheel magneto 70 serving as a power generator driven by power transmitted from the engine 10 is arranged to be controlled by the electronic control unit 100 and by the variable-voltage electric generating system 102. Therefore, an exclusive component is not required to be provided for applying a load to the engine 10, and therefore the structure is simple, and the occurrence of an abnormal noise can be restrained without adding mechanical components.

More specifically, in the present preferred embodiment, an arrangement is provided in which the rotational fluctuation of the flywheel (the rotor 72 and so forth) joined to the crankshaft 53 of the engine 10 is detected, and a load opposite in phase to the rotational fluctuation is applied from the flywheel magneto 70 to the crankshaft 53. According to this arrangement, the rotational fluctuation of the engine 10 is detected by using the flywheel that is a component used to stabilize the rotation of the engine 10, and a load can be applied to the engine 10 preferably via the flywheel magneto 70 serving as a power generator. Thus, the relative rotation speed between the drive shaft and the propeller shaft resulting from the rotational fluctuation of the engine can be reduced without providing an exclusive mechanical component.

Additionally, in the present preferred embodiment, an engine load that is opposite in phase to a variation in the engine rotation speed is arranged to be generated from the flywheel magneto 70 under the condition that the rotational fluctuation of the engine 10 satisfies the engine load control condition (step S3 of FIG. 6). In other words, in the present preferred embodiment, an engine load that cancels the relative rotation speed between the drive shaft 11 and the propeller shaft 12 is not always generated, and is controlled under the condition that the engine load control condition is satisfied. Therefore, a useless control operation can avoid being performed, and a useless load can avoid being applied to the engine 10. More specifically, the engine load control condition is that the absolute value of an engine rotation speed deviation is greater than a predetermined threshold value (e.g., about 20 rpm). In other words, a condition concerning an engine rotation speed deviation that is a variation width of the actual engine rotation speed with respect to the targeted engine rotation speed proportionate to a throttle opening degree that is a thrust force command value to be generated by the outboard motor 1 is the engine load control condition. As described above, the propeller shaft 12 rotates while receiving resistance from water, and therefore great fluctuations do not occur in its rotation. On the other hand, the engine 10 inevitably undergoes rotational fluctuations resulting from unevenness in torque caused by combustion, and the rotational fluctuation of the engine 10 is a main cause of the relative rotation speed between the drive shaft 11 and the propeller shaft 12. Therefore, if a load onto the engine 10 is controlled when the absolute value of an engine rotation speed deviation becomes great, the relative rotation speed between the drive shaft 11 and the propeller shaft 12 can be effectively reduced. In other words, when the absolute value of an engine rotation speed deviation is small and hence the rotational fluctuation of the engine 10 is small, i.e., when the relative rotation speed between the drive shaft 11 and the propeller shaft 12 is small, a remarkable abnormal noise (a gear rattle in the dog clutch 20) does not occur. Therefore, a gear rattle can be effectively reduced by the arrangement of the present preferred embodiment that controls the engine load when the absolute value of an engine rotation speed deviation is great.

Additionally, in the present preferred embodiment, an engine load that is opposite in phase to an engine rotation speed deviation is arranged not to be generated when a predetermined engine load control prohibition condition is satisfied. More specifically, when the engine rotation speed exceeds an engine rotation speed threshold value (step S1 of FIG. 6: NO), the engine load control to cancel the engine rotation speed deviation is not performed. When the engine rotation speed is high, the engine 10 generates great output, and the propeller 17 receives great resistance from water, and therefore the engagement state of the gears in the dog clutch 20 is stable. Additionally, an engine sound is loud, and therefore an abnormal noise caused from the dog clutch 20 is muffled by the engine sound. Therefore, a useless control operation can be omitted by prohibiting the control of the engine load when the engine rotation speed is high, and a needless load can avoid being applied to the engine 10. In this way, the engine load can be controlled under an appropriate condition.

Additionally, in the present preferred embodiment, the engine load control to cancel an engine rotation speed deviation is not performed if the throttle opening degree changes during a past fixed time (step S2 of FIG. 6: YES). In other words, the engine load control is prohibited during a fixed time during which the actual engine rotation speed has not yet reached the targeted engine rotation speed proportionate to the throttle opening degree that is a thrust force command value after this throttle opening degree changes. Therefore, when the throttle opening degree changes, a thrust force proportionate to the throttle opening degree can be generated by allowing the engine rotation speed to promptly reach the targeted engine rotation speed. The engine 10 is in an accelerated state or a decelerated state until the actual engine rotation speed reaches the targeted engine rotation speed after the throttle opening degree changes, and the engagement between gears in the dog clutch 20 is stable, and the possibility that a gear rattle will occur is low. From this viewpoint, the necessity of controlling the load of the engine is low during a period before the actual engine rotation speed reaches the targeted engine rotation speed.

Although one preferred embodiment of the present invention has been described above, the present invention can be further embodied in other forms. For example, instead of detecting the rotational fluctuation of the engine 10, the relative rotation speed between the drive shaft 11 and the propeller shaft 12 may be detected directly. In detail, a propeller shaft rotation sensor that detects the rotation speed of the propeller shaft 12 may be provided, and a difference between the rotation speed of the drive shaft 11 calculated from the output of the crank angle sensor 95 and the output of the propeller shaft rotation sensor may be calculated as the relative rotation speed. Thereafter, a load torque may be applied from the flywheel magneto 70 to the crankshaft 53 so as to cancel this relative rotation speed.

Additionally, although the flywheel magneto 70 is shown as a power generator that preferably applies a load torque to the engine 10 in the above preferred embodiment, the load torque applied to the engine 10 can be varied even if another type power generator, such as an alternator, is provided.

Additionally, although the outboard motor 1 is shown as a marine vessel propulsion device in the above preferred embodiment, a stern drive, as well as the outboard motor 1, can be mentioned as an example of the marine vessel propulsion device to which the present invention is applicable.

The present application corresponds to Japanese Patent Application No. 2011-234779 filed in the Japan Patent Office on Oct. 26, 2011, and the entire disclosure of the application is incorporated herein by reference.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A marine vessel propulsion device comprising:

an engine;

a propeller shaft;

a drive shaft that is rotated by power transmitted from the engine;

a dog clutch that transmits rotation of the drive shaft to the propeller shaft;

a crank angle sensor that detects a rotation speed of the drive shaft; and a throttle-opening-degree sensor that detects a throttle opening degree proportionate to a targeted engine rotation speed; and an engine load generating unit that determines a relative rotation speed between the drive shaft and the propeller shaft based on the rotation speed of the drive shaft and the targeted engine rotation speed, and that generates an engine load opposite in phase to the relative rotation speed detected therebetween.

2. The marine vessel propulsion device according to claim 1, wherein the engine load generating unit includes:

a power generator that is driven by power transmitted from the engine; and a control unit that controls a load of the power generator.

3. The marine vessel propulsion device according to claim 1, further comprising a flywheel joined to a crankshaft of the engine, wherein the engine load generating unit detects a rotational fluctuation of the flywheel and applies to the flywheel a load opposite in phase to the rotational fluctuation detected by the engine load generating unit.

4. The marine vessel propulsion device according to claim 3, wherein the engine load generating unit includes:

a power generator that generates electric power by rotation of the flywheel; and a control unit that controls a load of the power generator.

5. The marine vessel propulsion device according to claim 1, wherein under a condition that the relative rotation speed satisfies an engine load control condition, the engine load generating unit generates an engine load that is opposite in phase to the relative rotation speed.

6. The marine vessel propulsion device according to claim 5, wherein the engine load control condition includes a condition concerning a magnitude of the relative rotation speed.

7. The marine vessel propulsion device according to claim 6, wherein the condition concerning the magnitude of the relative rotation speed includes a condition concerning a variation width of an actual rotation speed of the engine with respect to the targeted engine rotation speed proportionate to a thrust force command value to be generated by the marine vessel propulsion device.

8. The marine vessel propulsion device according to claim 1, wherein when an engine load control prohibition condition is satisfied, the engine load generating unit does not generate an engine load that is opposite in phase to the relative rotation speed.

9. The marine vessel propulsion device according to claim 8, wherein the engine load control prohibition condition includes an operational state condition concerning an operational state of the marine vessel propulsion device.

10. The marine vessel propulsion device according to claim 9, wherein the operational state condition includes a condition that the rotation speed of the engine is greater than a threshold value.

11. The marine vessel propulsion device according to claim 9, wherein the operational state condition includes a condition that an actual rotation speed of the engine has not yet reached the targeted engine rotation speed proportionate to a thrust force command value to be generated by the marine vessel propulsion device after the thrust force command value changes.

12. A marine vessel propulsion device comprising:

an engine;

a propeller shaft;

a drive shaft that is rotated by power transmitted from the engine;

a dog clutch that transmits rotation of the drive shaft to the propeller shaft;

a crank angle sensor that detects a rotation speed of the drive shaft; and a throttle-opening-degree sensor that detects a throttle opening degree proportionate to a targeted engine rotation speed; and a control unit that determines a relative rotation speed between the drive shaft and the propeller shaft based on the rotation speed of the drive shaft and the targeted engine rotation speed, and that changes an engine load to reduce the relative rotation speed.

* * * * *